US008942529B2

(12) United States Patent
Auzerais et al.

(10) Patent No.: US 8,942,529 B2
(45) Date of Patent: Jan. 27, 2015

(54) FIBRE OPTIC TAPE ASSEMBLY

(75) Inventors: François Auzerais, Boston, MA (US); Ernest Brown, Sugar Land, TX (US); Arthur Hartog, Winchester (GB); Simon James, Le Plessis-Robinson (FR); Philippe Gambier, La Defense (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 147 days.

(21) Appl. No.: 13/121,367

(22) PCT Filed: Sep. 11, 2009

(86) PCT No.: PCT/EP2009/006746

§ 371 (c)(1), (2), (4) Date: Jun. 22, 2011

(87) PCT Pub. No.: WO2010/037478

PCT Pub. Date: Apr. 8, 2010

(65) Prior Publication Data

US 2011/0240163 A1 Oct. 6, 2011

(30) Foreign Application Priority Data

Oct. 3, 2008 (EP) ..... 08165852

(51) Int. Cl.

| | |
|---|---|
| ***G02B 6/44*** | (2006.01) |
| ***G02B 6/46*** | (2006.01) |
| ***E21B 17/10*** | (2006.01) |
| ***E21B 47/12*** | (2012.01) |

(52) U.S. Cl.

CPC ..... *E21B 17/1035* (2013.01); *E21B 47/123* (2013.01)

USPC ..... 385/114

(58) Field of Classification Search

USPC ..... 385/114

See application file for complete search history.

(56) References Cited

U.S. PATENT DOCUMENTS

| | | | | |
|---|---|---|---|---|
| 4,806,400 | A * | 2/1989 | Sancaktar | 428/35.9 |
| 4,823,166 | A | 4/1989 | Hartog et al. | |
| 5,268,983 | A | 12/1993 | Tatarka et al. | |
| 6,364,370 | B1 * | 4/2002 | Honda | 285/322 |
| 6,463,813 | B1 * | 10/2002 | Gysling | 73/862.59 |
| 6,507,686 | B1 * | 1/2003 | Heinz et al. | 385/100 |
| 6,771,863 | B2 | 8/2004 | Oxford et al. | |
| 6,868,737 | B2 | 3/2005 | Croteau et al. | |
| 6,947,648 | B2 | 9/2005 | Rossi et al. | |
| 6,988,854 | B2 | 1/2006 | Porter | |
| 7,206,482 | B2 | 4/2007 | Rhyne et al. | |
| 7,244,337 | B2 | 7/2007 | Bahlmann et al. | |

(Continued)

FOREIGN PATENT DOCUMENTS

GB 2359834 9/2001

OTHER PUBLICATIONS

Technische Universitaet Muenchen (Sep. 7, 2009). Metaklett, A Steely Hook and Loop Fastener. ScienceDaily.

*Primary Examiner* — Omar R Rojas

(74) *Attorney, Agent, or Firm* — Brandon Clark; David J. Groesbeck

(57) ABSTRACT

An optical fiber tape assembly for attaching an optical fiber to the surface of a pipe comprising; at least one optical fiber; and a tape having an attachment means to enable attachment of the tape to the pipe; wherein the optical fiber runs longitudinal along the tape and is integral with the tape.

11 Claims, 5 Drawing Sheets

(56) References Cited

U.S. PATENT DOCUMENTS

| | | | | |
|---|---|---|---|---|
| 7,303,022 | B2 | 12/2007 | Tilton et al. | |
| 7,308,175 | B1 | 12/2007 | Jackman et al. | |
| 7,322,245 | B2 | 1/2008 | Gysling et al. | |
| 7,428,366 | B2 * | 9/2008 | Mullaney et al. | 385/139 |
| 2003/0217605 | A1 * | 11/2003 | Croteau et al. | 73/861.44 |
| 2005/0057942 | A1 | 3/2005 | Mako et al. | |
| 2005/0074196 | A1 | 4/2005 | Grigsby et al. | |
| 2005/0101192 | A1 | 5/2005 | Foskey | |
| 2007/0133932 | A1 | 6/2007 | Kingsford et al. | |
| 2008/0187276 | A1 * | 8/2008 | Roberts et al. | 385/114 |

* cited by examiner

FIBRE OPTIC TAPE ASSEMBLY

TECHNICAL FIELD

This invention relates to a tape assembly comprising a fiber optic cable. In particular to a tape for attaching a fiber optic cable to the surface of a tubular in a well.

BACKGROUND ART

There is significant interest in attaching sensors to the outside of casing or tubulars in subterranean wells to provide information on the changes in the downhole environment either continuously or periodically, particularly in oil and gas well bores. However one of the challenges is the transmission of information between the sensors and the surface.

Previously, cables have been attached to the outside of casing with clamps and other mechanical devices, to transmit information from the sensors to the surface, but the size of the cables used and the mechanical fixation methods has limited the applicability of the installation.

Generally it has not been considered appropriate to attach elongated objects of a significant diameter to a well casing in the cement path because there is a risk that there will be insufficient penetration of cement in the interstices between the casing and object and between the object and the wellbore wall, which would therefore result in a leak path from formation to the surface. In turn, such a path is a risk to the integrity of the isolation from formation to surface and thus unacceptable on environmental and safety grounds.

Another challenge is that wellbore environments may have extreme conditions in terms of e.g. pressure, temperature, pH or chemical environment. This has limited the possibility to attach sensors to the outer surface of a pipe without using clamps, as the attaching mechanism must first resist such extreme conditions and then have enough flexibility to follow the axial and circumferential geometry of the pipe.

The object of the invention is to overcome the limitations of the previous methods using a tape for attaching optic fibers to the outside surface of tubulars.

DISCLOSURE OF THE INVENTION

This invention provides an optical fiber tape assembly for attaching an optical fiber to the surface of a pipe for use in wellbore environments, particularly in subterranean wells comprising;

a tape having magnetic attachment means to enable attachment of the tape to the pipe; and at least one optical fiber that runs substantially parallel to the longitudinal axis of the tape;

wherein the optical fiber is integral with the tape.

Preferably the longitudinal edges of the tape are tapered such that the tape has a trapezoid cross section.

In an embodiment, the attachment means of the assembly may be an adhesive layer on the tape.

The assembly can further comprise protective elements. The protection elements may be wires, the wires running parallel to the optical fiber, tubes with the optical fiber located inside the tube, and/or a coating layer for covering the optical fiber.

A second embodiment of the invention comprises a system for a wellbore, preferably subterranean well, comprising:

at least one section of pipe; and a optical fiber tape assembly as described above; wherein the tape assembly is attached to the outer surface of the section of pipe.

The system can comprise at least two pipe sections and a wedge; wherein the wedge is located at a joint between two pipe sections and the tape assembly is attached over the wedge.

Another embodiment of the invention comprises a method for attaching a optical fiber to the surface of a pipe comprising; deploying a tape as described above from a storage device; and attaching the tape to the surface of the pipe as the pipe is deployed into a well.

The method can comprise attaching the tape longitudinally along the pipe as the pipe is being run into a well.

The method can comprise attaching protective elements to the outside surface of the tape as it is deployed from the storage device.

The method can further comprise attaching wedges at joints in the pipe and placing the tape over the wedges.

Preferably the method comprises using an apparatus as described above.

MODE(S) FOR CARRYING OUT THE INVENTION

Figure 1:
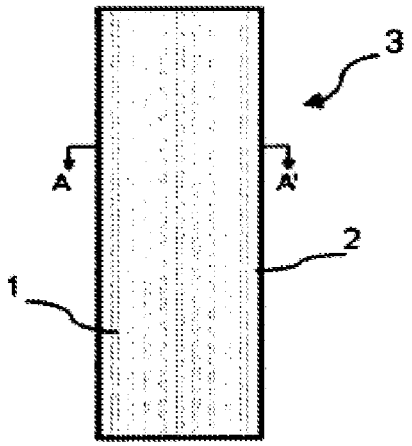
FIG. 1 shows a schematic view of the invention.
Figure 2:
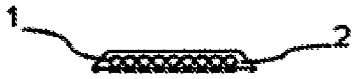
FIG. 2 shows a cross-sectional view across line A-A' of FIG. 1.
Figure 3:
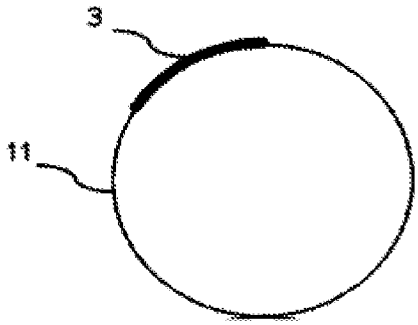
FIG. 3 shows a schematic cross-sectional view of the tape attached to a pipe.
Figure 9:
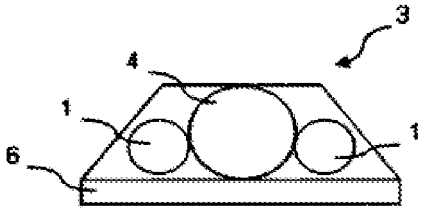
Figure 10:
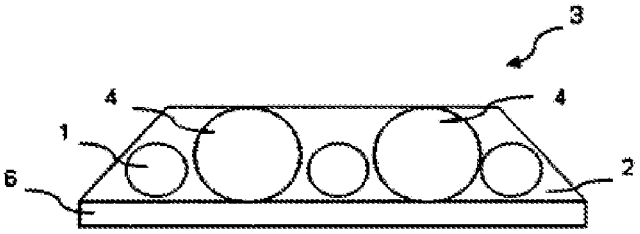

The apparatus according to the invention is applicable for attaching optical fibers to the surface of tubulars, in particular to the outer surface of a casing or tubular in a subterranean well. The optical fibers can be used for sensing and/or to transmit information up and/or down the wellbore. As shown in FIGS. 1 and 2 the optical fibers 1 are integrated with the body 2 of the tape 3, such that a single item is formed, with the optical fiber fully located between the upper and lower surfaces of the tape. The tape may include one or more layers of any suitable material. The tape 3 is sufficiently flexible to be deformed and attached to the well casing 11 or pipe as shown in FIG. 3. As apparent in said Figure, the tape according to the present invention is flexible along the length of the assembly and also along its width. The length flexibility is necessary for spooling on and off for example a dispenser (as in FIG. 9); the width flexibility allows the assembly to hold correctly on a pipe when aligned axially along the length of said pipe. Without such flexibility, the assembly could catch on ledges present in the wellbore with the risk of seeing said assembly being ripped away from the pipe whilst the pipe is being placed in the wellbore. Also, any edges resulting from a lack of flexibility might adversely affect the subsequent placement of cement in the volume outside the pipe. For example cement may not be able to displace all the drilling fluid in the wellbore thus there will be regions without any cement. These voids in the cement sheath would reduce the efficiency of said cement sheath and compromise the zonal isolation. In one embodiment the tape may be an adhesive tape, having an adhesive layer on one surface of the tape to stick the tape onto the surface of the casing or tubular in a well. In a preferred embodiment, the tape comprises a magnetic layer, to enable the tape to attach to the tubular surface. Having a magnetic tape is especially preferred in a wellbore environment as often the tape needs to be attached to a dirty surface. Adhesives often do not work efficiently on dirty surfaces; thus, when such dirty surface is faced, the magnetic attachment is preferred. The tape could comprise a U-shaped metal layer. The metal layer allows the tape to be tack welded or brazed at points along the pipe to attach the tape to the pipe surface, the attachment means of the tape assembly may comprise one half of the system and the tubular being prepared with bands comprising the second half of the dual mechanical system on which the tape assembly can be attached to. The bands could be regularly placed around the tube or down the entire length of the tubular. In a preferred embodiment, the assembly is made of hook and loop fasteners made of spring steel. These fasteners are resistant to chemicals and can withstand a tensile load of up to 35 tonnes per square meter at temperatures as high as 800° C. Suitable fasteners are disclosed in Technische Universitaet Muenchen (2009, Sep. 7). Metaklett, A Steely Hook And Loop Fastener. ScienceDaily.

FIGS. 1 and 2 shows nine individual fibers 1 integrated into the body 2 of the tape 3, however the tape may contain any number of optical fibers and the number of fibers can range from one fiber to bundles of fibers that could contain several thousand fibers. The number and arrangement of the optical fibers within the tape will vary depending on what parameters are going to be measured or the communication to be sent through the fibers.

Figure 4:
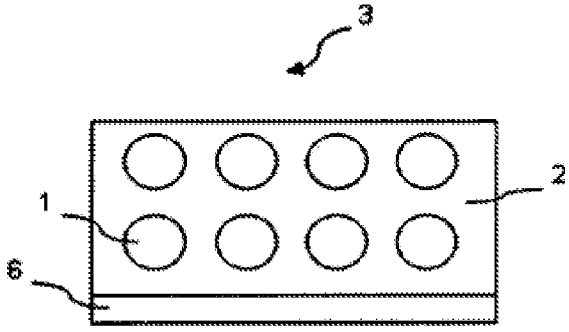
FIGS. 4 and 5 show schematic cross sectional views of embodiments of the invention.
Figure 5:
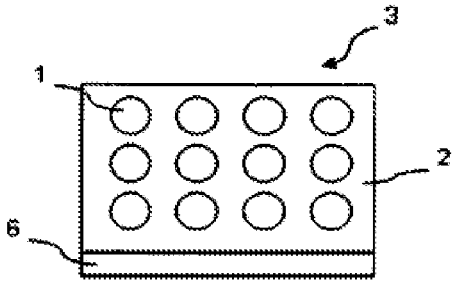
Figure 6:
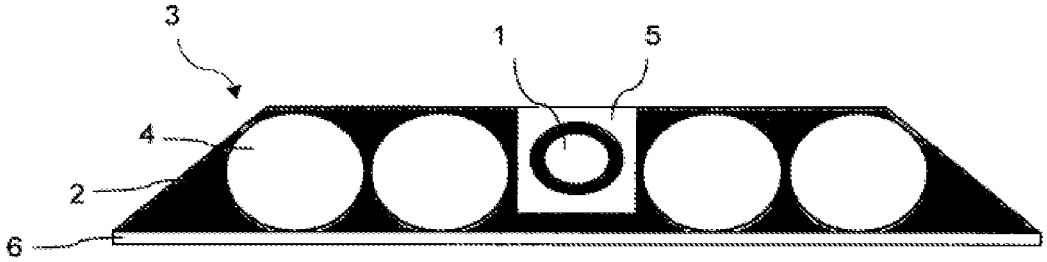
FIGS. 6-10 show schematic cross sectional views of embodiments of the invention with support elements.
Figure 7:
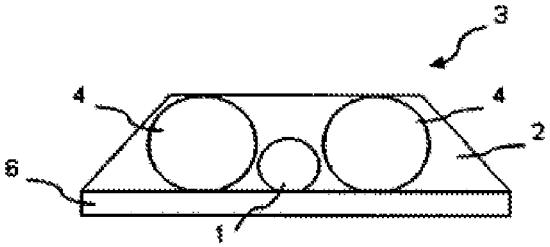
Figure 8:
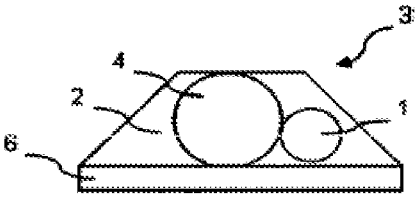

In some situation numerous fibers can be integrated into the tape so that should one fiber break and therefore lose transmission capabilities other fibers are still present in the tape that can be used for continuing the monitoring or transmitting process. As shown in FIGS. 4 and 5 the optical fibers 1 may be stacked in layers in the body 2 of the tape 3. However other configurations are possible. Integrating the optical fibers into the body of the tape helps protect the fiber against the environment in the well, i.e. cement, acid, $H_2S$ etc.

Alternatively some measurements that can be made with the optical fibers in the tape may require the use of more than one fiber, or fibers of different types. For example where the cables are for making distributed temperature measurements, the preferred fiber type is one of multimode designs, in this situation for most applications it is preferred to employ a fiber loop to allow cancellation of losses. In other types of measurements such as those based on interferometry, a fiber supporting a single transverse mode, possibly having two independent polarization states, is preferred. In other measurements, high birefringence fibers are preferred in order to deliver light in a known state of polarization to a sensor. Other types of fibers that can be used include pressure sensitive fibers, such as a side-hole fiber the birefringence of which is a function of isostatic pressure.

As shown in FIGS. 6-10 the tape can be structurally reinforced to provide mechanical protection to the optical fiber. Structural members 4 present in the body of the tape can help protect the optical fiber 1 from damage. Suitable structural supports include wires, cables or tubes. In one embodiment the fiber 1 is located in a groove 5 formed in the body 2 of the tape and the structural supports 4 are embedded in the body of the tape. Any number of protective wires may be used. In addition to protecting the optical fibers the protective wires can also be used to transmit signals and/or provide power downhole. The structural supports may run longitudinally along the length of the tape, so that they run parallel to the fibers, however the structural members can have any suitable arrangement, spacing, and/or shape to provide protection to the fibers. The tape also has a magnetic or adhesive layer 6 on its lower surface, for adhering the tape to the surface of the pipe. The tape can have tapered edges to help minimise the risk of the edges of the tape being lifted up once the tape has stuck to the pipe. The tape is shown having a generally trapezoid cross section. Tapering the edges of the tape towards the upper surface of the tape so that the width of the upper surface of the tape is narrower than the width of the lower surface of the tape can also help improve the placement of cement by eliminating pockets of drilling fluid and thus ensuring effective zone isolation in the well. As subterranean wellbores are usually cemented in order to provide zonal isolation, other assembly means such as for example Velcro could also lead to poor drilling fluid displacement thus creating voids in said cement sheath, resulting in a lack of zonal isolation.

Figure 11:
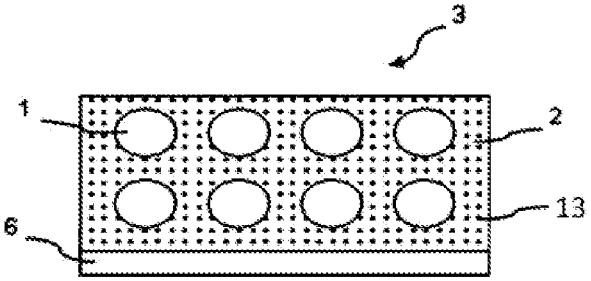
FIG. 11 shows a schematic cross sectional view of an embodiment of the invention.

With reference to FIG. 11 the body 2 of the tape 3 comprises reinforcement fibers 13, for example Kevlar, glass, carbon, steel fibers etc. to reinforce the body of the tape to increase the resistance of the optical fibers 1 against its own weight and shocks. The size of the reinforcing fibers can vary greatly and may be bigger than the optical fiber or smaller than the optical fiber. The reinforcing fibers do not need to be continuous throughout the body of the tape, instead a number of reinforcing fibers can be dispersed throughout the body of the tape to help protect the optical fiber.

Figure 12:
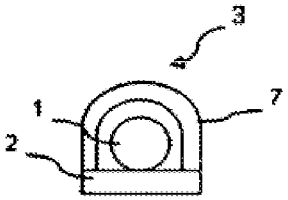
FIG. 12 shows a schematic cross sectional view of an embodiment of the invention.
Figure 13:
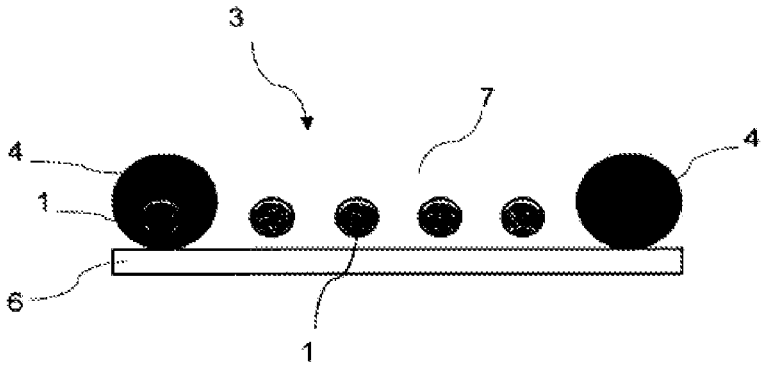
FIG. 13 shows a cross sectional view of one embodiment of the invention with support elements.

The tape may comprise mechanical and/or chemical protection mechanisms. As shown in FIG. 12 the tape can comprise a protective coating 7 over the optical fiber 1 embedded in the body 2 of the tape 3. In one embodiment as shown in FIG. 13 the tape comprises both chemical and mechanical protection. The tape comprises a material with an adhesive backing 6 and a coating layer 7 that covers the optical fibers 1 on the material and any structural supports 4 that may also be present. The tubes and/or wires 4 located in the tape help protect the fibers in the tape. The tubes and wires may have a slightly larger diameter than the fibers 1. In one embodiment the fibers 1 may be located within the support tubes 4. Single or multiple fibers may be located in the tube which may be made from materials including metal, composite material or plastics. The coating 7 also provides protection to the fibers, in particular the coating provides protection from the environment that the tape is exposed to. The fiber can be coated by one of more layers of a coating that sets to a film. The coating can also help maintain the fiber as integral to the tape. Any coating that is compatible with cement can be used. A coating that can provide bonding between the cement and the tape is preferred.

In order to attach the fiber optic cable to the surface of the pipe, a tape having the optical fiber integrated into the body of the tape can be attached to the pipe as the pipe is run into the well. The sticking of the tape to the surface of the pipe will also secure the cable to the surface of the pipe. In most cases the tape will be attached longitudinally along the length of the pipe in a continuous manner, however in some situations it may be required to wrap the tape around the pipe, in order to provide circumferential coverage of the fiber about the pipe.

Figure 14:
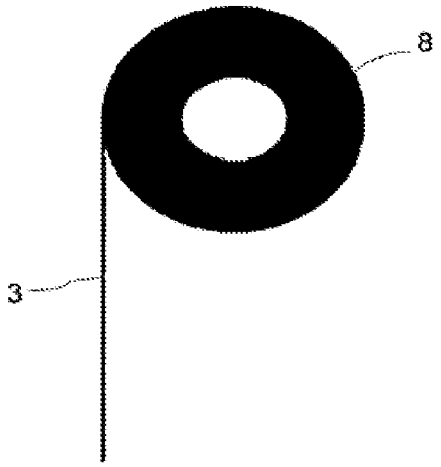
FIG. 14 shows a storage roll of the tape.
Figure 15:
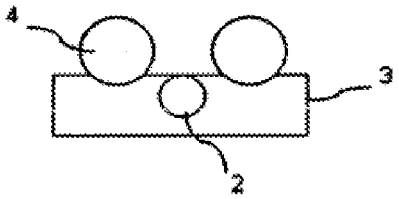
FIGS. 15 and 16 show cross sectional views of embodiments of the invention.
Figure 16:
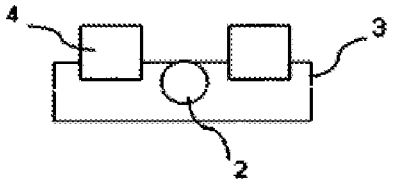

The tape can be applied to the pipe by applying a magnetic or adhesive layer to the tape. The tape 3 can be stored on a roll 8, as shown in FIG. 14. An adhesive dispenser may be situated close to the point at which the tape is unreeled from the roll from a supply bobbin. Before the tape is placed against the surface of the pipe the adhesive is applied to the back surface of the tape. Alternatively the tape may have the adhesive layer already applied to the tape when the tape is on the storage roll. A wide variety of adhesives can be used on the tape. In addition to the ability of the adhesive to hold the tape in place under the conditions of usage, the adhesive should also form a smooth transition between the pipe surface and upper surface of the tape. Types of adhesives that can be used include epoxy, acrylic, cyanoacryate, polyurethane, neoprene, silicone. The adhesive should also be capable of curing fast. This can be facilitated a number of ways including, chemically, i.e. by the use of two part glues, the use of heat, by the use of light of suitable wavelengths, e.g. UV or ionizing radiation and/or by the use of a pressure set mechanism.

Where the tape requires protective wires these wires can be pre formed into the tape or attached to the tape as it is deployed in order to reduce the size of the reel that that tape is stored on. As shown in FIGS. 15 and 16 the optical fiber is embedded into the body of the adhesive tape, and the protective wires are attached, for example by glue, to the outside of the tape during deployment of the tape from the reel. The tape may have preformed grooves in the tape in which the protective wires can be fitted in as the tape is deployed. In this case gluing the protective wires to the tape may not be necessary.

Figure 17:
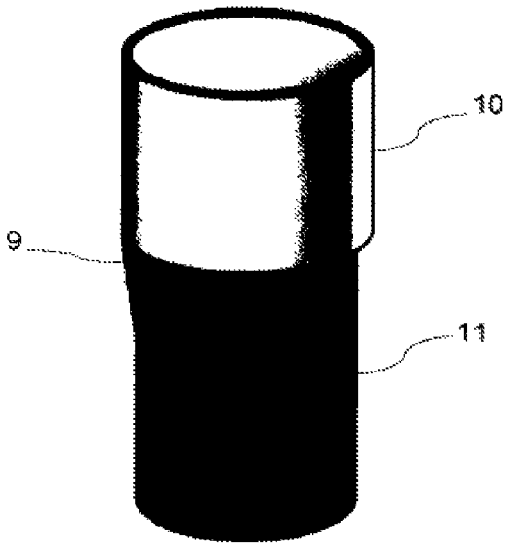
FIG. 17 shows the use of tapered wedges to be used with the tape.

The diameter of the pipe in the well can change along its length, for example at the junctions of a casing collar on the pipe. As the tape is attached to the surface these changes in diameter can cause unwanted stress to occur to the tape and optic fiber. As shown in FIG. 17 a tapered wedge 9 may be used to prevent untoward stresses being generated in the tape as it passes oversteps in the tubular, e.g. a casing collar 10 on casing 11. These wedges 9 can be attached directly to the casing 11 at the point of concern using an adhesive or magnetic connection, to reduce stress being generated in the tape.

Figure 18:
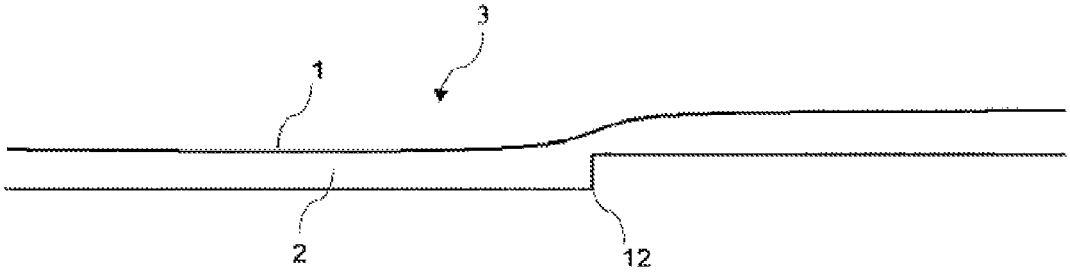
FIG. 18 shows a cross-sectional representation of the tape over a discontinuity of a casing.

An alternative way of preventing damage when the tape passes over changes in the tubular dimensions is shown in FIG. 18. The tape should have sufficient flexibility to ensure that the fiber is not damaged when the tape is bent. In this case the tape is sufficiently thick and deformable and/or compressible such that the tape 3 itself deforms and cushions the optic fiber 1 from damage when passing over a tubing discontinuity 12. The body 2 of tape may be formed of a material such as natural rubber, EPDM (Ethylene-Propylene-Diene Monomer) rubber, epoxy resin, PEEK (Polyetheretherketone), PEK (Polyetherketone) or any suitable thermoplastic or thermoset polymers. The key factor in choosing an appropriate body material is that the material must resist the thermal and chemical environment of the wellbore. These and other materials may be foamed so as to provide energy absorbent systems to help prevent damage to the integrated optical fibers.

The cable assembly according to the invention can be used to support communication with sensors placed in the formation or at discrete positions along the well trajectory. It may also be a means of deploying distributed sensors along at least part of the well trajectory and provide measurements of the formation or information about the flow within the tubing. For example, in conjunction with permeable cement, the invention can be used to provide information on the pressure in the formation.

A further application is for at least one of the fibers in the tape to be used as an acoustic sensor, for example by means of coherent optical time-domain reflectometry techniques, and can be used in a number of seismic applications, such as permanent vertical seismic profiling or passive micro seismic detection, where small seismic events resulting from movement in the formation are detected and triangulated to provide information for example, on drainage of fluids or the position and status of geological faults.

The sensors can also be used for analysing the acoustic signal resulting from flow and thus indication of flow rates and/or presence of more than one phase, including the detection of solids. Very localised noise detection might also allow the presence of leaks behind casing to be detected and thus provide improved well integrity.

Various changes within the scope of the invention can also be made.

The invention claimed is:

1. A system for a wellbore comprising:

at least one section of pipe; and an optical fiber tape assembly comprising:

a tape having an attachment means to enable attachment of the tape to the pipe, wherein the pipe is cylindrical and the tape is designed to be attached longitudinally along the pipe;

at least one optical fiber that runs substantially parallel to the longitudinal axis of the tape; and protective elements, wherein the protective elements are attached to the outside of the tape;

wherein the optical fiber is integral with the tape, at least one optical fiber being located within a support tube, the support tube also being integral with the tape, and the tape assembly is attached to the outer surface of the section of pipe.

2. The system according to claim 1 comprising at least two pipe sections and a wedge; wherein the wedge is located at a joint between two pipe sections and the tape assembly is attached over the wedge.

3. A method for attaching an optical fiber to the surface of a pipe comprising:

deploying a tape from a storage device, said tape having attachment means to enable attachment of the tape and at least one optical fiber to the pipe; the optical fiber being integral with the tape and at least one fiber being located within a support tube, the support tube also being integral with the tape;

attaching the tape to the surface of the pipe as the pipe is deployed into a well, wherein the pipe is cylindrical and the tape is attached longitudinally along the pipe; and attaching protective elements to the outside surface of the tape as it is deployed into the well, wherein the protective elements are wires running parallel to the optical fiber.

4. The method according to claim 3 wherein attaching the tape to the pipe comprises attaching the tape as the pipe is being run into the well.

5. The method according to claim 3 further comprising attaching wedges at joints in the pipe and placing the tape over the wedges.

6. The system of claim 1, wherein the attachment means is an adhesive layer on the tape.

7. The system of claim 1, wherein the attachment means is a magnetic material.

8. The system of claim 1 further comprising wires running parallel to the optical fiber.

9. The system of claim 1, wherein the tape comprises a coating layer covering the optical fiber.

10. The method of claim 3, wherein the attachment means is an adhesive layer on the tape.

11. The method of claim 3, wherein the attachment means is a magnetic material.

* * * * *